US008414108B2

(12) United States Patent
Fang

(10) Patent No.: US 8,414,108 B2
(45) Date of Patent: Apr. 9, 2013

(54) EJECTION CHIP FOR MICRO-FLUID APPLICATIONS

(75) Inventor: Jiandong Fang, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 186 days.

(21) Appl. No.: 12/916,796

(22) Filed: Nov. 1, 2010

(65) Prior Publication Data

US 2012/0105545 A1 May 3, 2012

(51) Int. Cl.
*B41J 2/135* (2006.01)

(52) U.S. Cl. ..... 347/44; 347/85; 347/89; 347/92; 347/54; 422/500; 422/504; 405/37; 235/375; 235/494

(58) Field of Classification Search ..... None
See application file for complete search history.

(56) References Cited

U.S. PATENT DOCUMENTS

| | | | | |
|---|---|---|---|---|
| 5,455,615 | A * | 10/1995 | Burr et al. | 347/92 |
| 6,679,596 | B2 * | 1/2004 | Boyd et al. | 347/89 |
| 6,682,176 | B2 * | 1/2004 | Silverbrook | 347/54 |
| 7,226,156 | B2 * | 6/2007 | Boyd et al. | 347/89 |
| 2009/0194600 | A1 * | 8/2009 | Lapstun et al. | 235/494 |
| 2010/0147940 | A1 * | 6/2010 | Lapstun et al. | 235/375 |

* cited by examiner

*Primary Examiner* — Hai C Pham
*Assistant Examiner* — John P Zimmermann

(57) ABSTRACT

Disclosed is an ejection chip for an inkjet printhead that includes at least one fluid via configured on the ejection chip for supplying fluid to one or more ejecting elements of the ejection chip. Each fluid via of the at least one fluid via includes a plurality of end-to-end coupled segments. Each segment of the plurality of end-to-end coupled segments is aligned at a skew angle with a consecutive segment. Further, the ejection chip includes a plurality of nozzles configured along a length of the each segment of the plurality of end-to-end coupled segments with a first nozzle spatial density. The configuration of the plurality of nozzles facilitates in achieving a predetermined print resolution with the first nozzle spatial density.

13 Claims, 17 Drawing Sheets

EJECTION CHIP FOR MICRO-FLUID APPLICATIONS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to ejection chips for micro-fluid applications, and more particularly, to an ejection chip for an inkjet printhead.

2. Description of the Related Art

A typical micro-fluidic printhead, and more particularly, an inkjet printhead, utilizes a micro-fluid ejection device in the form of an ejection chip. Further, the inkjet printhead includes a nozzle plate either attached to or integrated with the ejection chip. The nozzle plate includes a plurality of nozzles for ejecting fluid for printing purposes. Further, the ejection chip includes one or more fluid vias configured thereon and arranged along the plurality of nozzles. The one or more fluid vias facilitate the flow of fluid from a fluid reservoir to one or more ejecting elements of the inkjet printhead.

A traditional ejection chip includes straight fluid vias configured adjacent to a plurality of nozzles. FIG. 1 depicts a layout of an ejection chip 100 that includes at least one fluid via, such as a fluid via 102, a fluid via 104, and a fluid via 106.

The fluid vias 102, 104 and 106 are depicted to be straight fluid vias. The ejection chip 100 also includes a plurality of nozzles, such as a plurality of nozzles 108 configured along the fluid via 102, a plurality of nozzles 110 configured along the fluid via 104, and a plurality of nozzles 112 configured along the fluid via 106. Specifically, the nozzles 108, 110 and 112 are configured along respective longitudinal sides (not numbered) of the fluid vias 102, 104, and 106. As depicted in FIG. 1, a distance between neighboring fluid vias, such as the fluid via 102 and the fluid via 104, of the at least one fluid via may be about 1616.5 micrometer (μm) (depicted by 'D1'). Further, each fluid via of the fluid vias 102, 104, and 106 may have a width of about 218 μm (depicted by 'D2'). Furthermore, a horizontal distance between two respective nozzles of the nozzles 108, 110 and 112, configured on either longitudinal side of the respective fluid vias 102, 104 and 106 may be about 24"/1800 (depicted by 'D3'); a vertical distance between the two respective nozzles of the nozzles 108, 110 and 112, configured on the either longitudinal side of the fluid vias 102, 104 and 106, may be about 1"/1800 (depicted by 'D4'); a vertical distance between two consecutive nozzles of the nozzles 108, 110 and 112, configured on respective first longitudinal sides (not numbered) of the fluid vias 102, 104 and 106 may be about 1"/900 (depicted by 'D5'); and a horizontal distance between the nozzles 108 and 110, and the nozzles 110 and 112 configured on the respective first longitudinal sides (not numbered) of the fluid vias 102 and 104, and 104 and 106, may be about 130"/1800 (depicted by 'D6').

It has been observed that two consecutive/neighboring nozzles, such as neighboring nozzles of the nozzles 108 configured along the fluid via 102, of the ejection chip 100 may need to have a separation distance (depicted by 'S' in FIG. 2) of about 28.2 μm to achieve a print resolution of about 1800 dots per inch (dpi). Further, a flow feature width (depicted as 'F' in FIG. 2) between the two consecutive nozzles may be of about 11 μm. It has been observed that the flow feature width needs to be reduced in order to achieve higher print resolutions. However, a typical Photo Imageable Nozzle Plate (PINP) forming process favors wider flow feature separation between two consecutive/neighboring nozzles for achieving a strong adhesion between the flow feature and an ejection chip/a nozzle plate of an inkjet printhead. Consequently, a sufficient value of the flow feature width is desired to achieve enough adhesion with maximum possible resolution for a reliable PINP forming process.

Accordingly, there persists a need for an ejection chip for an inkjet printhead, which overcomes the drawbacks and limitations of prior art ejection chips. Specifically, there persists a need for an ejection chip for an inkjet printhead that has a sufficiently wide flow feature separation and is capable of providing a high print resolution.

SUMMARY OF THE DISCLOSURE

In view of the foregoing disadvantages inherent in the prior art, the general purpose of the present disclosure is to provide an ejection chip for an inkjet printhead by including all the advantages of the prior art, and overcoming the drawbacks inherent therein.

Accordingly, the present disclosure provides an ejection chip for an inkjet printhead. The ejection chip includes at least one fluid via configured on the ejection chip for supplying fluid to one or more ejecting elements of the ejection chip; Each fluid via of the at least one fluid via includes a plurality of end-to-end coupled segments. Each segment of the plurality of end-to-end coupled segments is aligned at a skew angle with a consecutive segment. Further, the ejection chip includes a plurality of nozzles configured along a length of the each segment of the plurality of end-to-end coupled segments with a first nozzle spatial density. The configuration of the plurality of nozzles facilitates in achieving a predetermined print resolution with the first nozzle spatial density.

In another aspect, the present disclosure provides an ejection chip for an inkjet printhead. The ejection chip includes at least one fluid via configured on the ejection chip for supplying fluid to one or more ejecting elements of the ejection chip. Each fluid via of the at least one fluid via includes a plurality of end-to-end coupled segments. Each segment of the plurality of end-to-end coupled segments is aligned at a skew angle with a consecutive segment. Further, the ejection chip includes a plurality of nozzles configured along a length of the each segment of the plurality of end-to-end coupled segments with a first nozzle spatial density. The configuration of the plurality of nozzles facilitates in achieving a predetermined print resolution with the first nozzle spatial density. The first nozzle spatial density is less than a second nozzle spatial density that is required by the prior art for achieving the predetermined print resolution.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides an ejection chip for microfluid applications, and more specifically for an inkjet printhead. The ejection chip includes at least one fluid via configured on the ejection chip for supplying fluid to one or more ejecting elements of the ejection chip. Each fluid via of the at least one fluid via includes a continuous channel through the chip defined by a plurality of end-to-end coupled segments. Each segment of the plurality of end-to-end coupled segments is aligned at a skew angle with a consecutive segment. The skew angle may be one of an acute angle, an obtuse angle and a right angle. Further, the ejection chip includes a plurality of nozzles configured along a length of the each segment of the plurality of end-to-end coupled segments with a first nozzle spatial density. The configuration of the plurality of nozzles facilitates in achieving a predetermined print resolution with the first nozzle spatial density. The first nozzle spatial density is less than a second nozzle spatial density that is required by the prior art for achieving the predetermined print resolution. Accordingly, the aforementioned arrangement of the at least one fluid via and the plurality of nozzles facilitates the inkjet printhead to achieve a photo print quality with a reduced first nozzle spatial density in comparison to the second nozzle spatial density required for achieving the predetermined print resolution. The reduced first nozzle spatial density facilitates in achieving an improved reliability of Photo Imageable Nozzle Plate (PINP) forming processes, which favor wider flow feature separation between neighboring nozzles of the plurality of nozzles for better adhesion between a flow feature layer and the ejection chip/a nozzle plate of the inkjet printhead. Various embodiments of the ejection chip of the present disclosure are explained in conjunction with FIGS. 3-21.

Figure 3:
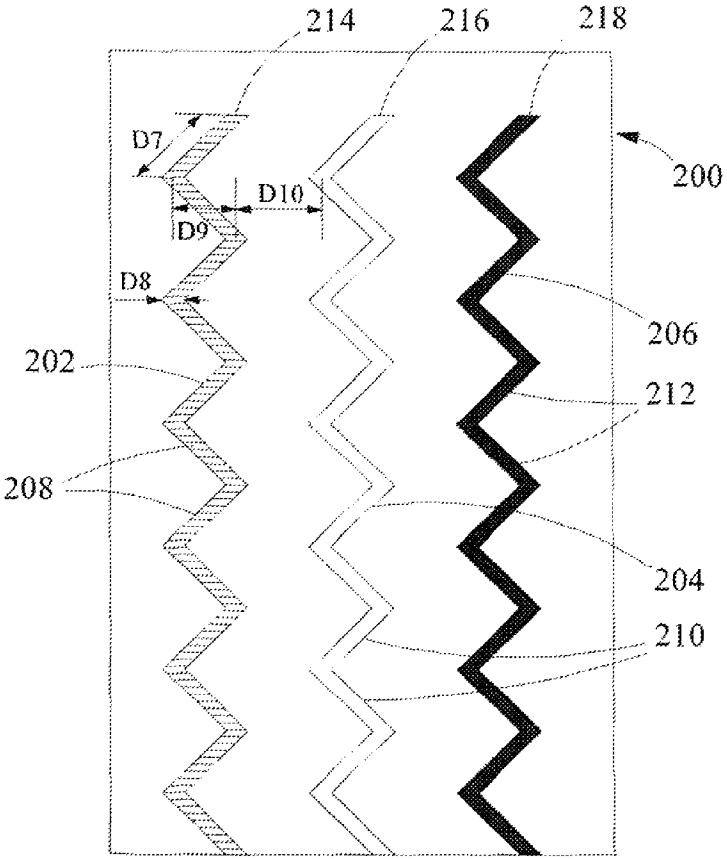
FIG. 3 illustrates a layout of an ejection chip depicting an arrangement of fluid vias, in accordance with an embodiment of the present disclosure.

FIG. 3 illustrates a layout of an ejection chip 200 depicting an arrangement of at least one fluid via, such as a fluid via 202, a fluid via 204, and a fluid via 206, in accordance with an embodiment of the present disclosure. Each fluid via of the fluid vias 202, 204 and 206 is configured on the ejection chip 200 for supplying fluid to one or more ejecting elements (not shown) of the ejection chip 200. Specifically, the fluid vias 202, 204 and 206 may supply a cyan-colored fluid, a magenta-colored fluid and a yellow-colored fluid, respectively. Further, the fluid vias 202, 204 and 206 may be configured either as through slots or as blind slots that feed one or more firing chambers (not shown) of the ejection chip 200 in order to supply fluid to the one or more ejecting elements of the ejection chip 200.

The each fluid via of the fluid vias 202, 204, and 206 includes a continuous channel of a plurality of end-to-end coupled segments. Specifically, the fluid via 202 includes a plurality of end-to-end coupled segments 208 (hereinafter referred to as "segments 208"), the fluid via 204 includes a plurality of end-to-end coupled segments 210 (hereinafter referred to as "segments 210"), and the fluid via 206 includes a plurality of end-to-end coupled segments 212 (hereinafter referred to as "segments 212"). Each segment of the segments 208 is aligned at a skew angle with a consecutive segment to configure a zigzag shape, and accordingly, the fluid via 202 is configured to have a zigzag shape. Specifically, the each segment of the segments 208 is aligned at a skew angle of about 45 degrees (°) with the consecutive segment to configure the zigzag shape. Similarly, each segment of the segments 210 is aligned at a skew angle with a consecutive segment to configure a zigzag shape, and accordingly, the fluid via 204 is configured to have a zigzag shape. Specifically, the each segment of the segments 210 is aligned at a skew angle of about 45° with the consecutive segment to configure the zigzag shape. Further, each segment of the segments 212 is aligned at a skew angle with a consecutive segment to configure a zigzag shape, and accordingly, the fluid via 206 is configured to have a zigzag shape. Specifically, the each segment of the segments 212 is aligned at a skew angle of about 45° with the consecutive segment to configure the zigzag shape.

Furthermore, the each segment of the respective segments 208, 210 and 212 has linear end portions. Specifically, the each segment of the segments 208 may have liner end portions, such as a liner end portion 214. Similarly, the each segment of the segments 210 may have liner end portions, such as a liner end portion 216. Further, the each segment of the segments 212 may have liner end portions, such as a linear end portion 218. In addition, the each segment of the respective segments 208, 210 and 212 has a length of about 1.41 millimeter (mm) (as depicted by 'D7'), a width of about 218 μm (as depicted by 'D8'), and a horizontal distance between a tip portion thereof (not numbered) and an end portion thereof (not numbered) of about 1 mm (as depicted by 'D9'). In addition, the segments 208 and 210, and the segments 210 and 212, may be configured in a spaced apart relation at a vertical distance of about 0.8 mm (as depicted by 'D10').

Figure 4:
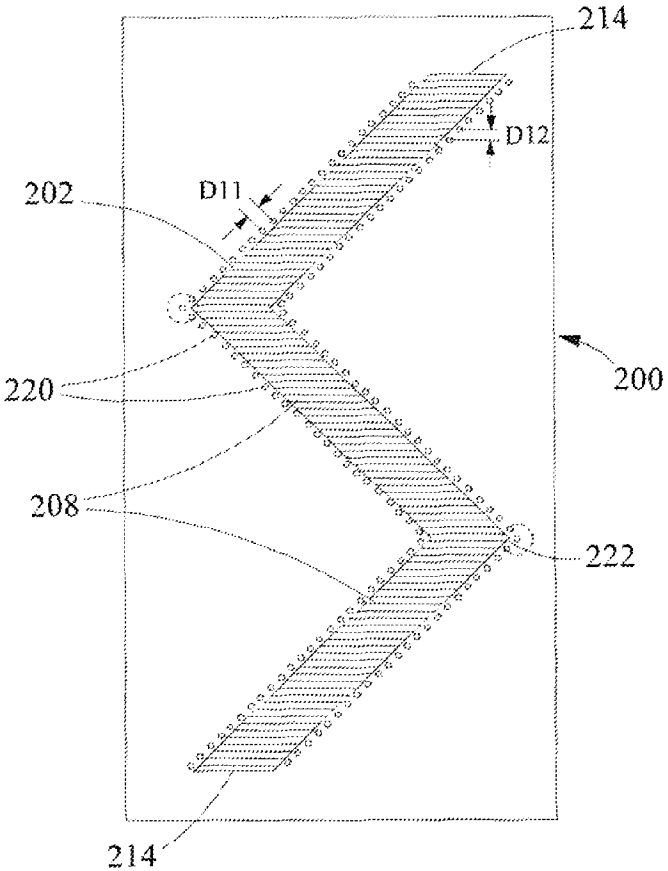
FIG. 4 illustrates a layout of the ejection chip of FIG. 3 depicting an arrangement of a fluid via and nozzles configured along the fluid via, in accordance with an embodiment of the present disclosure.

Referring to FIG. 4, the ejection chip 200 further includes a plurality of nozzles, such as a plurality of nozzles 220 configured along a length of the each segment of the segments 208, with a first nozzle spatial density. The configuration of the nozzles 220 facilitates in achieving a predetermined print resolution with the first nozzle spatial density. The first nozzle spatial density is less than a second nozzle spatial density that is required by the prior art for achieving the predetermined print resolution.

Figure 2:
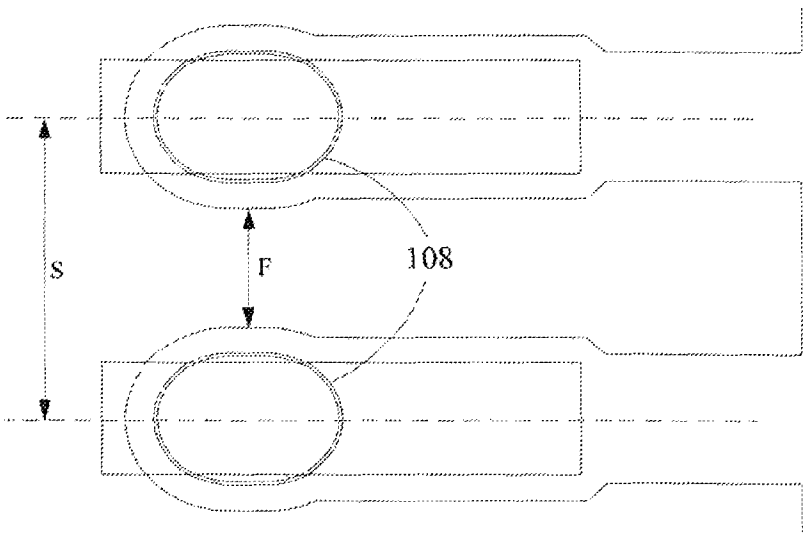
Figure 2 (Prior art)
FIG. 2 illustrates an arrangement of two consecutive nozzles of the ejection chip of FIG. 1.
Figure 1:
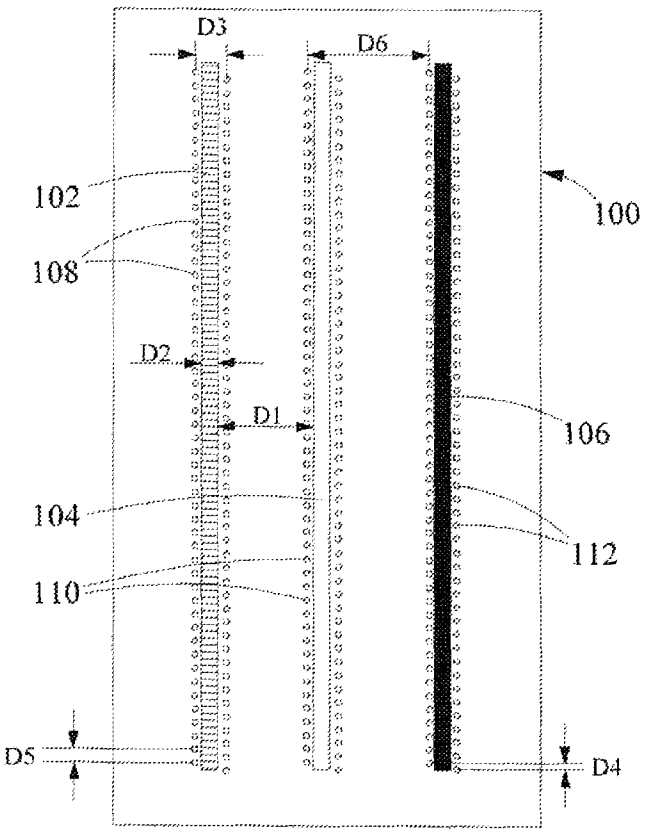
Figure 1 (Prior art)
FIG. 1 illustrates a layout of a prior art ejection chip depicting an arrangement of fluid vias and nozzles configured along the fluid vias.

For the purpose of this description, the predetermined print resolution is about 1800 Dots per Inch (dpi), the first nozzle spatial density is about 1273 dpi, and the second nozzle spatial density is about 1800 dpi. The second nozzle spatial density is the spatial density for nozzles of prior art ejection chips, such as the ejection chip 100 and is required to achieve the predetermined print resolution of about 1800 dpi. Specifically, and as depicted in FIG. 1, the nozzles 108 of the ejection chip 100 have the vertical distance of about 1"/900 between the two consecutive nozzles configured on a first longitudinal side (not numbered) of the fluid via 102 to achieve the print resolution of about 1800 dpi. However, FIG. 4 depicts that the alignment of the segments 208 of the fluid via 202 facilitates an arrangement of the nozzles 220 to have a reduced nozzle spatial density, i.e., the first nozzle spatial density of about 1273 dpi in order to achieve the print resolution of about 1800 dpi. Specifically, the nozzles 220 may be arranged to have a distance of about 1"/636.5 (i.e., 1273 dpi arrangement, as depicted by 'D11' in FIG. 4) between two consecutive nozzles while still maintaining a vertical distance of about 1"/900 (as depicted by 'D12' in FIG. 4) for achieving the print resolution of about 1800 dpi. Accordingly, such an arrangement reduces the nozzle spatial density, i.e., the first nozzle spatial density, in comparison to the second nozzle spatial density, and increases flow feature width between the nozzles 220 for achieving a better adhesion to the ejection chip 200 while achieving the same print resolution of about 1800 dpi.

Further, the alignment of the segments 208 facilitates in configuring a nozzle of the nozzles 220 at a respective concave corner point 222 between two consecutive segments of the segments 208 (as depicted by encircled portions in FIG. 4). Such an arrangement facilitates a seamless stitching between print zones of the each segment of the segments 208. Alternatively, the alignment of the segments 208 may facilitate in configuring a nozzle of the nozzles 220 at a respective convex corner point 224 between the two consecutive segments of the segments 208 (as depicted by encircled portions in FIG. 5). Such an arrangement also facilitates a seamless stitching between the print zones of the each segment of the segments 208.

Figure 6:
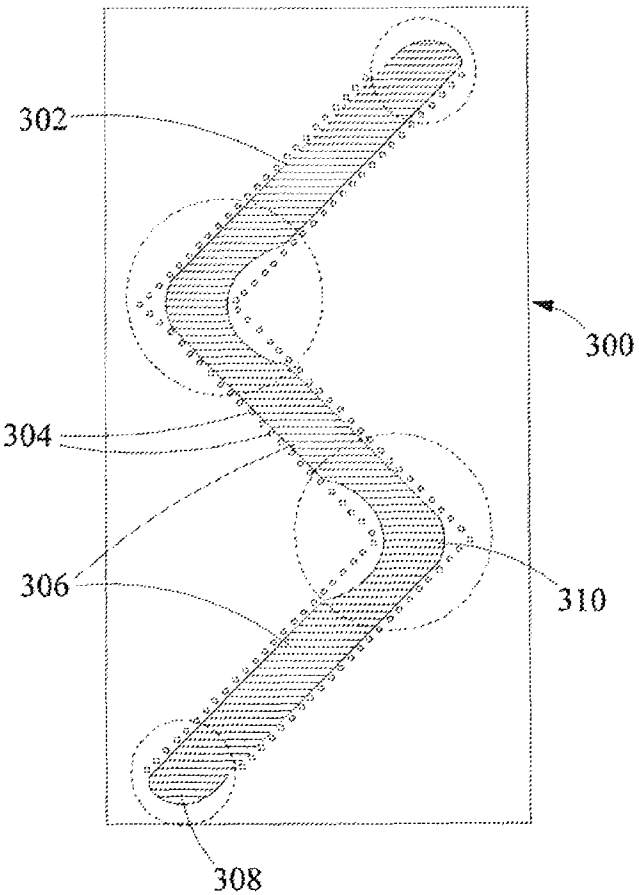
FIG. 6 illustrates a layout of an ejection chip depicting an arrangement of a fluid via and nozzles configured along the fluid via, in accordance with another embodiment of the present disclosure.
Figure 5:
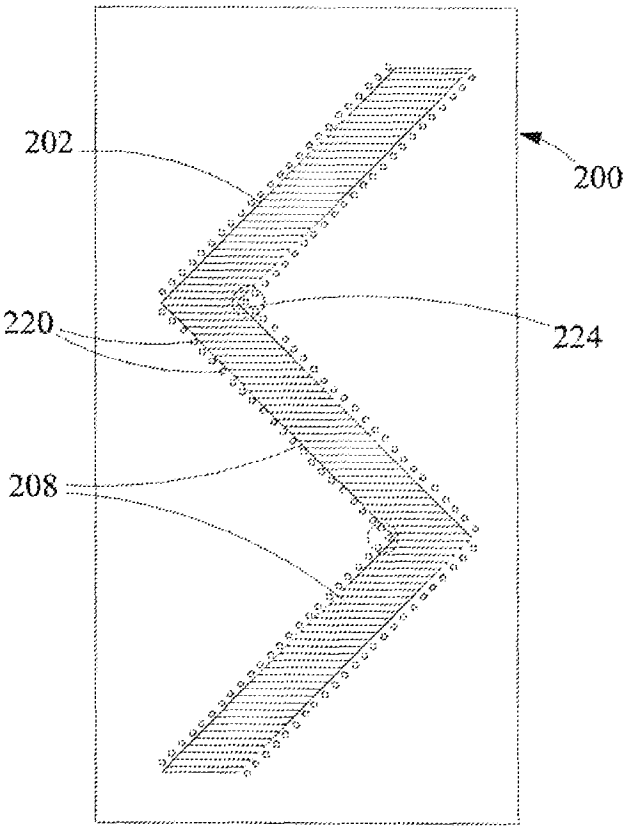
FIG. 5 illustrates a layout of the ejection chip of FIG. 3 depicting an arrangement of a fluid via and nozzles configured along the fluid via, in accordance with another embodiment of the present disclosure.

FIG. 6 illustrates a layout of an ejection chip 300 depicting an arrangement of a fluid via 302 and a plurality of nozzles 304 configured along the fluid via 302, in accordance with another embodiment of the present disclosure. The fluid via 302 is similar to the fluid via 202 and includes a plurality of end-to-end coupled segments 306 (hereinafter referred to as "segments 306"). However, each segment of the segments 306 has curved end portions, such as end portions 308 and 310 (as depicted by encircled portions in FIG. 6). Such an arrangement facilitates in removing possible dead corners for fluid flow through the fluid via 302. Accordingly, configuration of the fluid via 302 reduces bubble entrapment from within the ejection chip 300.

Figure 7:
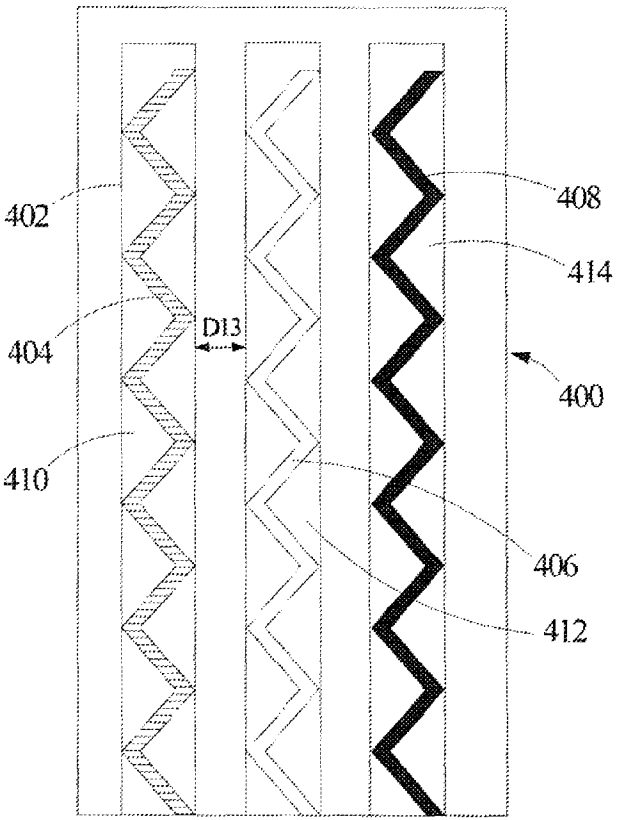
FIG. 7 illustrates a layout of an ejection chip and a base thereof, in accordance with an embodiment of the present disclosure.

FIG. 7 illustrates a layout of an ejection chip 400 and a base 402 of the ejection chip 400, in accordance with an embodiment of the present disclosure. The ejection chip 400 is similar to the ejection chip 200, and includes fluid vias 404, 406 and 408. However, the ejection chip 400 is fabricated on the base 402 that includes a plurality of fluid slots, such as a fluid slot 410, a fluid slot 412 and a fluid slot 414, underlying a respective fluid via of the fluid vias 404, 406 and 408. Specifically, the fluid slot 410 underlies the fluid via 404, the fluid slot 412 underlies the fluid via 406, and the fluid slot 414 underlies the fluid via 408. Further, the fluid slots 410, 412 and 414 may be configured in a spaced apart relation at a distance of about 0.6 mm (as depicted by 'D13').

The fluid slots 410, 412 and 414 are straight fluid slots. It may be evident to a person skilled in the art that the base 402, which may be made of ceramic, may include conformal zigzag fluid slots to feed the ejection chip 400 with a fluid, such as ink. However, such a configuration of the fluid slots may be associated with a high cost incur for the molding process required to make the base 402. Accordingly, the base 402 has been shown to include straight fluid slots 410, 412 and 414 beneath the respective fluid vias 404, 406 and 408.

Figure 8:
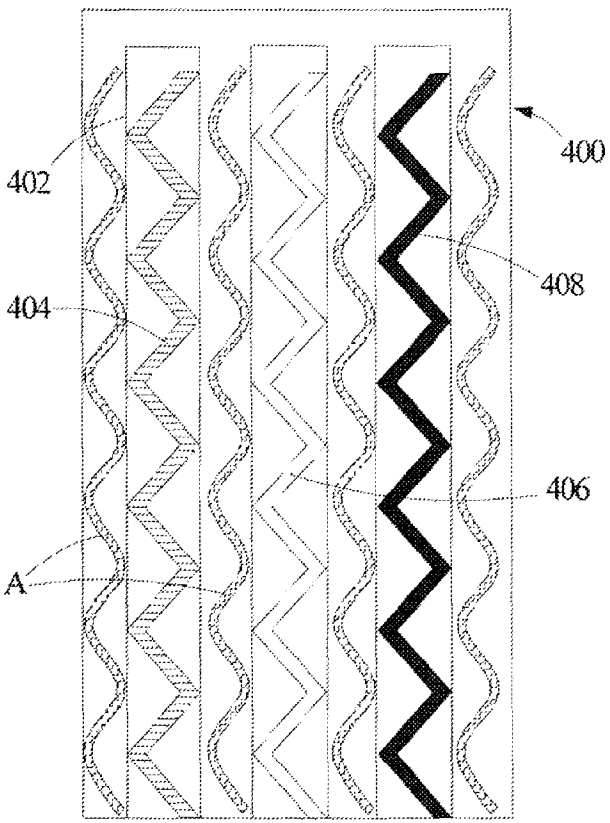
FIG. 8 illustrates a layout of the ejection chip of FIG. 7 depicting a pattern of an adhesive employed for fabricating an inkjet printhead, in accordance with an embodiment of the present disclosure.

FIG. 8 illustrates a layout of the ejection chip 400 of FIG. 7 depicting a pattern of an adhesive employed for fabricating an inkjet printhead, in accordance with an embodiment of the present disclosure. Specifically, symbol 'A' depicts the pattern for adhesive dispensing to avoid squeezing of the adhesive into the fluid vias 404, 406 and 408 for blocking the fluid vias 404, 406 and 408 during assembly of the ejection chip 400.

It has been observed that narrow ejection chips are preferred in scanning printheads in order to reduce the cost of silicon, which is utilized for fabrication of the ejection chips. Considering the aforementioned, zigzag fluid vias as depicted in the present disclosure may also be employed in the narrow ejection chips. Specifically, narrow ejection chips that have a width less than about 2 mm may also have the zigzag fluid vias to improve print resolution without sacrificing PINP quality and reliability. However, a plurality of manifold holes may be configured within a base/substrate tile of a narrow ejection chip considering a narrow seal distance with regard to challenging adhesive dispensing required for the fabrication of the narrow ejection chip.

Figure 9:
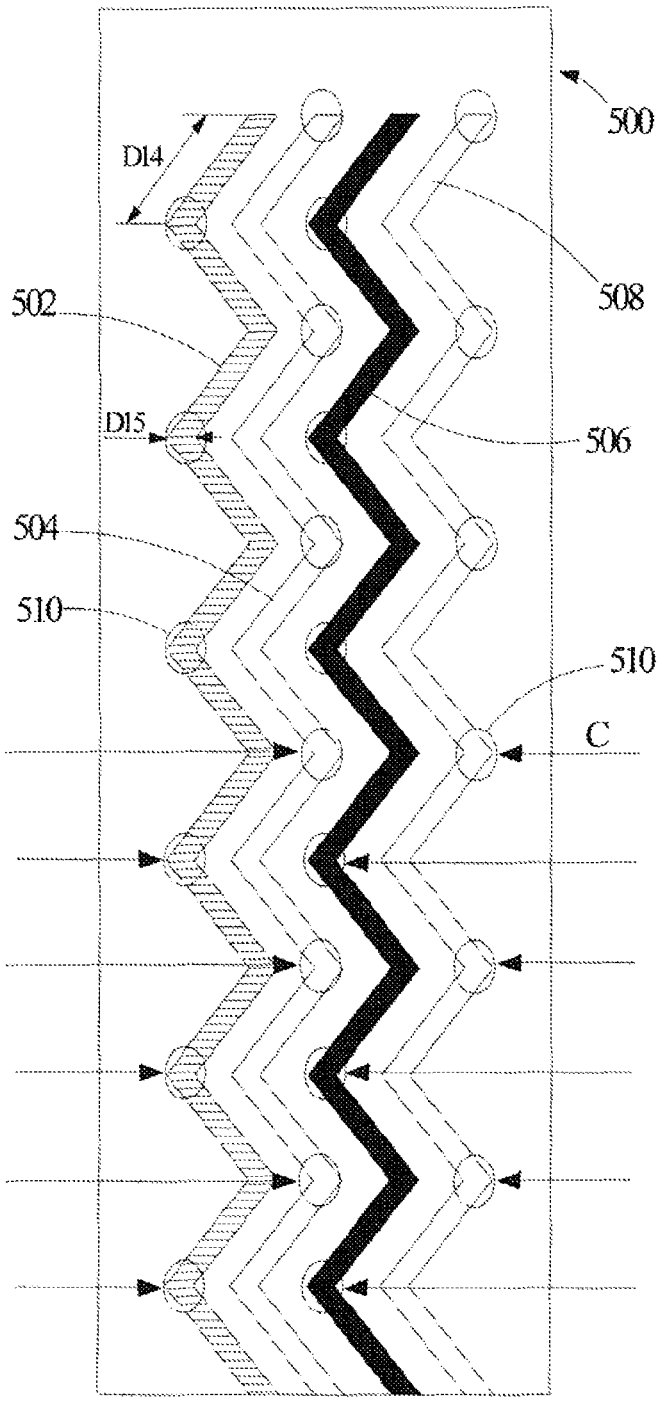
FIG. 9 illustrates a layout of an ejection chip depicting an arrangement of fluid vias and manifold holes configured within a base of the ejection chip, in accordance with an embodiment of the present disclosure.

FIG. 9 illustrates a layout of a narrow ejection chip 500 depicting an arrangement of fluid vias and manifold holes configured within a base of the ejection chip 500, in accordance with an embodiment of the present disclosure. Specifically, the ejection chip 500 includes a fluid via 502, a fluid via 504, a fluid via 506 and a fluid via 508. Each fluid via of the fluid vias 502, 504, 506 and 508 is a zigzag fluid via similar to the fluid via 202 of the ejection chip 200 of FIG. 3 and includes end-to-end coupled segments (not numbered). Each segment of the end-to-end coupled segments may have a length of about 1.41 mm (as depicted by 'D14') and a width of about 100 μm (as depicted by 'D15'). Further, the ejection chip 500 includes a plurality of manifold holes 510 configured within a base (not shown) of the ejection chip 500 and adjacent to the fluid vias 502, 504, 506 and 508 for fluid distribution. The manifold holes 510 are configured in the base for achieving higher print resolution without sacrificing PINP adhesion pattern. Specifically, each manifold hole of the manifold holes 510 may be coupled to a fan-out fluidic channel (not numbered), such as a channel depicted by a directional arrow 'C' of the base for the fluid distribution.

In another aspect, zigzag fluid vias may also be used for multiple ejection chips that need to be stitched in a line to construct stationary page wide printheads. Further, the ejection chips may be stitched together either through an NN-type of in-line stitching pattern or an MW-type of in-line stitching pattern. It will be evident to a person skilled in the art that the NN-type of in-line stitching pattern or an MW-type of in-line stitching pattern may be obtained using conventional methods as known to a person skilled in the art.

Figure 10:
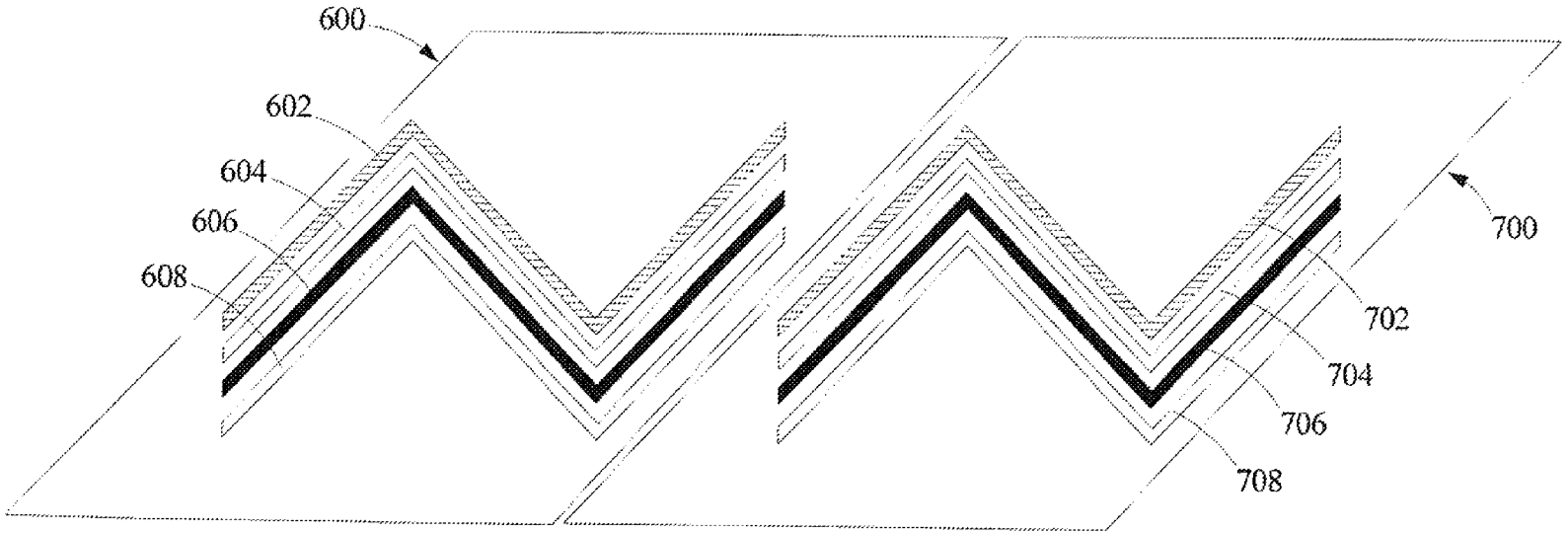
FIG. 10 illustrates a layout of NN type of in-line stitching pattern of ejection chips depicting an arrangement of non-redundant fluid vias, in accordance with an embodiment of the present disclosure.

FIG. 10 illustrates a layout of NN type of in-line stitching pattern of ejection chips 600 and 700 depicting an arrangement of non-redundant fluid vias, in accordance with an embodiment of the present disclosure. Specifically, the ejection chip 600 includes non-redundant zigzag fluid vias, such as a fluid via 602, a fluid via 604, a fluid via 606, and a fluid via 608, and the ejection chip 700 includes non-redundant zigzag fluid vias, such as a fluid via 702, a fluid via 704, a fluid via 706, and a fluid via 708. Each fluid via of the fluid vias 602, 604, 606 and 608 may be employed for supplying fluid of a particular color, such as cyan, magenta, yellow and black, to one or more ejecting elements (not shown) of the ejection chip 600. Similarly, each fluid via of the fluid vias 702, 704, 706 and 708 may be employed for supplying fluid of a particular color, such as cyan, magenta, yellow and black, to one or more ejecting elements (not shown) of the ejection chip 700. Further, each ejection chip of the ejection chips 600 and 700 is characterized by a small fluid via seal distance (i.e., a distance between two adjacent fluid vias of the each ejection chip) and a small chip edge seal distance (i.e., a distance between a respective edge, such as a horizontal edge (not numbered), of the each ejection chip and a respective fluid via thereof).

Figure 11:
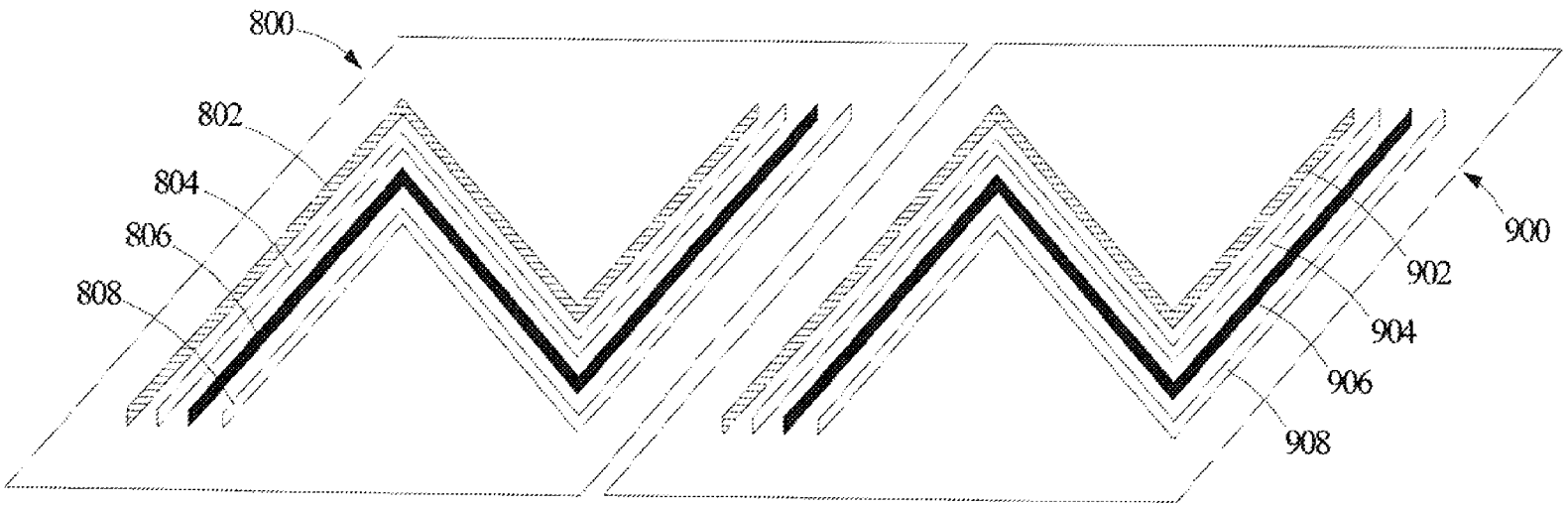
FIG. 11 illustrates a layout of NN type of in-line stitching pattern of ejection chips depicting an arrangement of non-redundant fluid vias, in accordance with another embodiment of the present disclosure.

FIG. 11 illustrates a layout of NN type of in-line stitching pattern of ejection chips 800 and 900 depicting an arrangement of non-redundant fluid vias, in accordance with another embodiment of the present disclosure. Specifically, the ejection chip 800 includes non-redundant zigzag fluid vias, such as a fluid via 802, a fluid via 804, a fluid via 806, and a fluid via 808, and the ejection chip 900 includes non-redundant zigzag fluid vias, such as a fluid via 902, a fluid via 904, a fluid via 906, and a fluid via 908. Each fluid via of the fluid vias 802, 804, 806 and 808 may be employed for supplying fluid of a particular color, such as cyan, magenta, yellow and black, to one or more ejecting elements (not shown) of the ejection chip 800. Similarly, each fluid via of the fluid vias 902, 904, 906 and 908 may be employed for supplying fluid of a particular color, such as cyan, magenta, yellow and black, to one or more ejecting elements (not shown) of the ejection chip 900. Further, each ejection chip of the ejection chips 800 and 900 is characterized by a small fluid via seal distance and a large chip edge seal distance.

Figure 12:
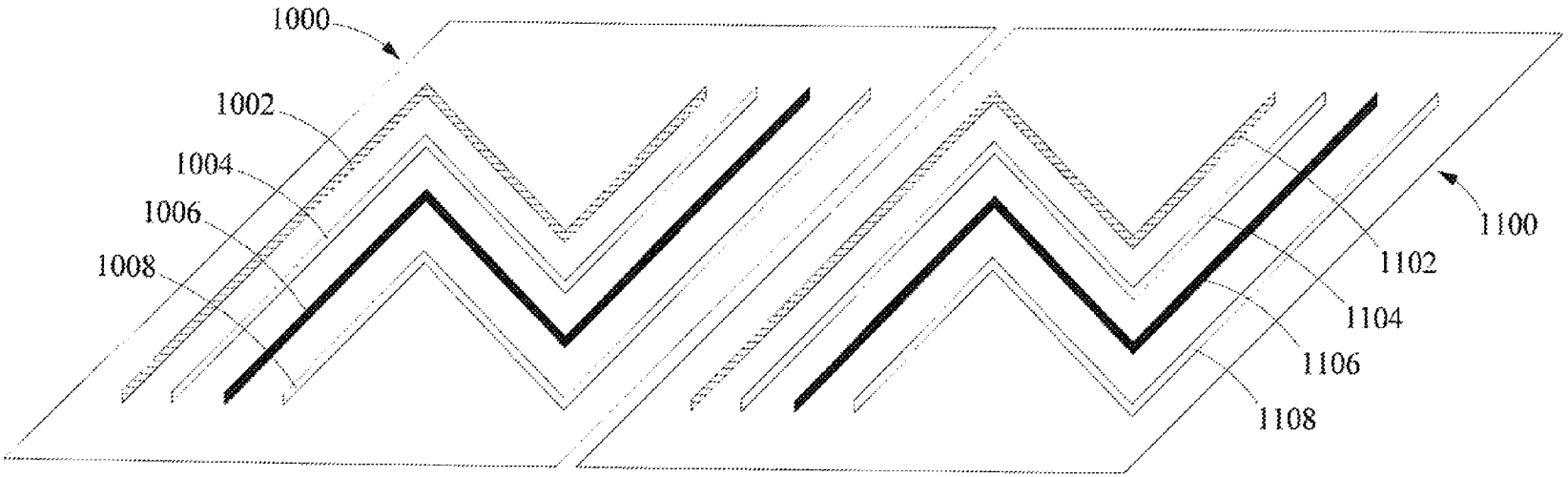
FIG. 12 illustrates a layout of NN type of in-line stitching pattern of ejection chips depicting an arrangement of non-redundant fluid vias, in accordance with yet another embodiment of the present disclosure.

FIG. 12 illustrates a layout of NN type of in-line stitching pattern of ejection chips 1000 and 1100 depicting an arrangement of non-redundant fluid vias, in accordance with yet another embodiment of the present disclosure. Specifically, the ejection chip 1000 includes non-redundant zigzag fluid vias, such as a fluid via 1002, a fluid via 1004, a fluid via 1006, and a fluid via 1008, and the ejection chip 1100 includes non-redundant zigzag fluid vias, such as a fluid via 1102, a fluid via 1104, a fluid via 1106, and a fluid via 1108. Each fluid via of the fluid vias 1002, 1004, 1006 and 1008 may be employed for supplying fluid of a particular color, such as cyan, magenta, yellow and black, to one or more ejecting elements (not shown) of the ejection chip 1000. Similarly, each fluid via of the fluid vias 1102, 1104, 1106 and 1108 may be employed for supplying fluid of a particular color, such as cyan, magenta, yellow and black, to one or more ejecting elements (not shown) of the ejection chip 1100. Further, each ejection chip of the ejection chips 1000 and 1100 is characterized by a large fluid via seal distance and a large chip edge seal distance.

Figure 13:
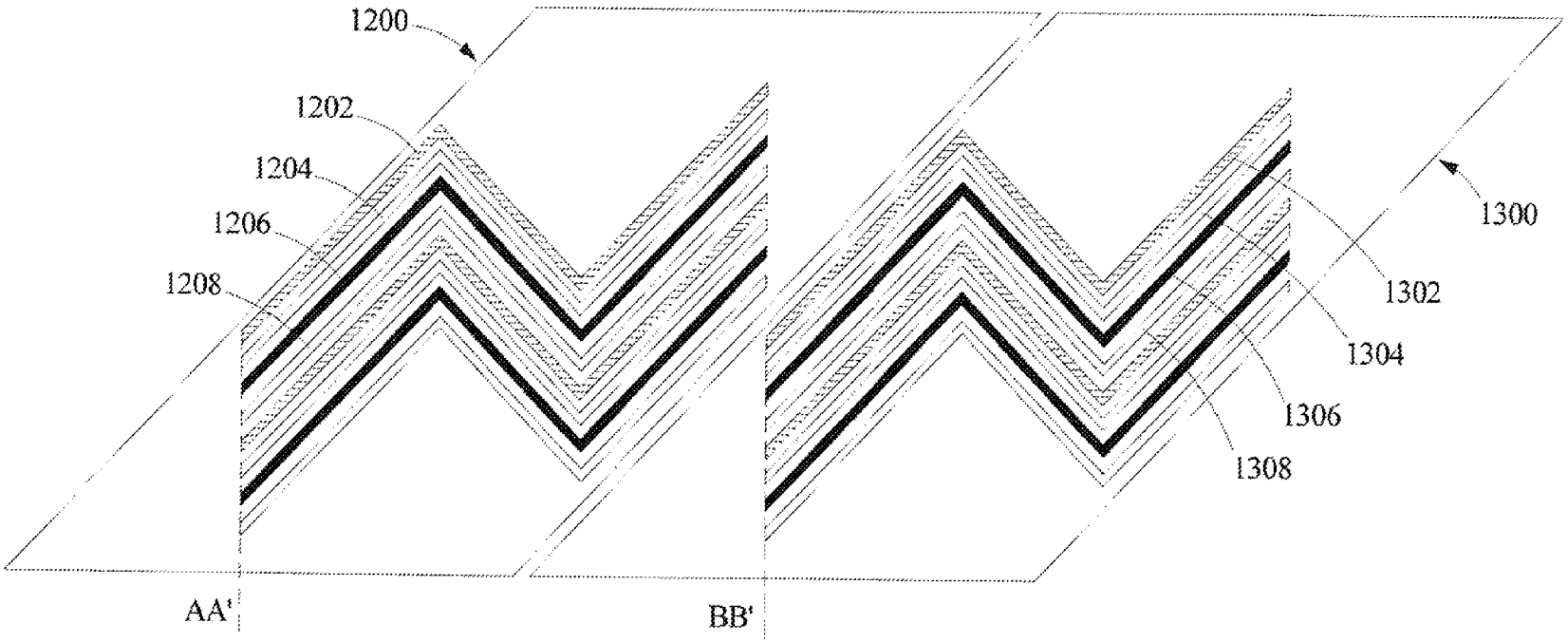
FIG. 13 illustrates a layout of NN type of in-line stitching pattern of ejection chips depicting an arrangement of redundant fluid vias, in accordance with an embodiment of the present disclosure.

FIG. 13 illustrates a layout of NN type of in-line stitching pattern of ejection chips 1200 and 1300 depicting an arrangement of redundant fluid vias, in accordance with an embodiment of the present disclosure. Specifically, the ejection chip 1200 includes redundant zigzag fluid vias, such as a fluid via 1202, a fluid via 1204, a fluid via 1206, and a fluid via 1208, and the ejection chip 1300 includes zigzag redundant fluid vias, such as a fluid via 1302, a fluid via 1304, a fluid via 1306, and a fluid via 1308. Each fluid via of the fluid vias 1202, 1204, 1206 and 1208 may be employed for supplying fluid of a particular color, such as cyan, magenta, yellow and black, to one or more ejecting elements (not shown) of the ejection chip 1200. Similarly, each fluid via of the fluid vias 1302, 1304, 1306 and 1308 may be employed for supplying fluid of a particular color, such as cyan, magenta, yellow and black, to one or more ejecting elements (not shown) of the ejection chip 1300. Further, the fluid vias 1202, 1204, 1206 and 1208 are aligned along a vertical line AA' at one or more edges (not numbered) of the ejection chip 1200, in order to provide full nozzle redundancy across the ejection chip 1200. Similarly, the fluid vias 1302, 1304, 1306 and 1308 are aligned along a vertical line BB' at one or more edges (not numbered) of the ejection chip 1300, in order to provide full nozzle redundancy across the ejection chip 1300.

Figure 14:
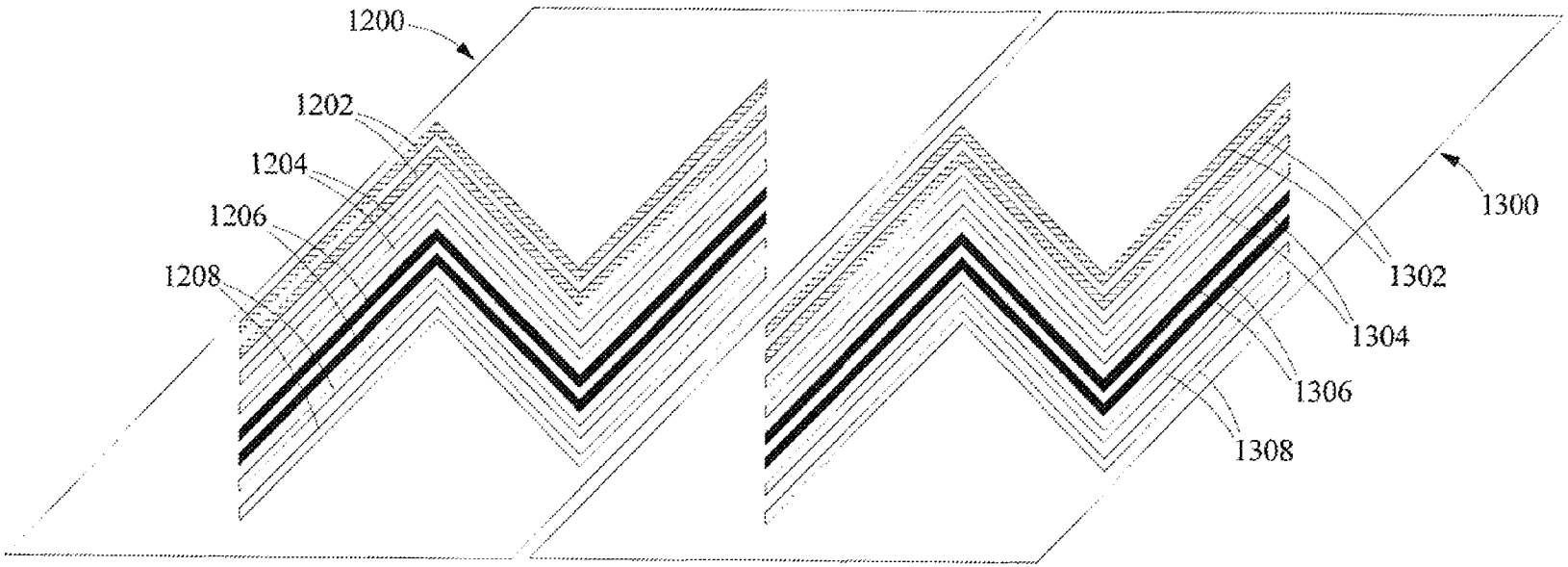
FIG. 14 illustrates a layout of NN type of in-line stitching pattern of the ejection chips of FIG. 13 depicting another arrangement of the redundant fluid vias, in accordance with an embodiment of the present disclosure.

FIG. 14 illustrates a layout of NN type of in-line stitching pattern of the ejection chips 1200 and 1300 depicting another arrangement of the redundant fluid vias, in accordance with an embodiment of the present disclosure. Specifically, the redundant fluid vias, such as the fluid vias 1202, which correspond to the same fluid color may be arranged together as depicted in FIG. 14.

Figure 15:
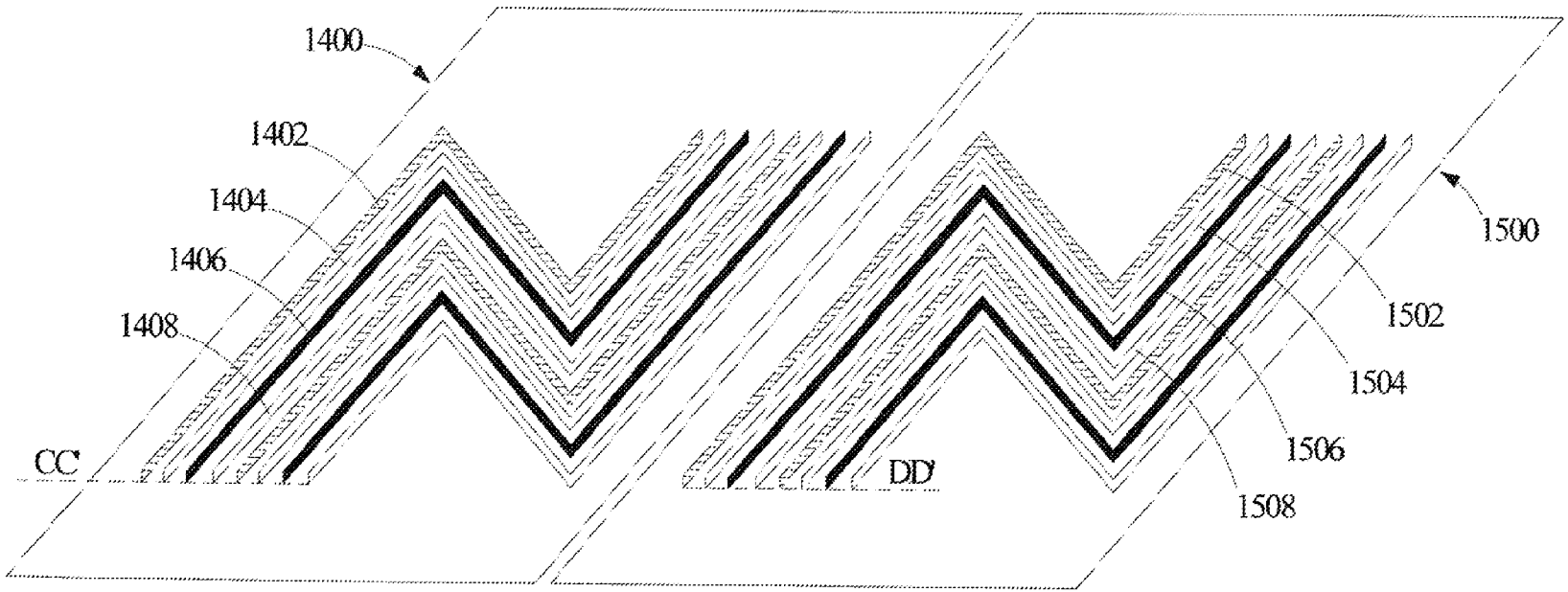
FIG. 15 illustrates a layout of NN type of in-line stitching pattern of ejection chips depicting an arrangement of redundant fluid vias, in accordance with another embodiment of the present disclosure.

FIG. 15 illustrates a layout of NN type of in-line stitching pattern of ejection chips 1400 and 1500 depicting an arrangement of redundant fluid vias, in accordance with yet another embodiment of the present disclosure. Specifically, the ejection chip 1400 includes redundant zigzag fluid vias, such as a fluid via 1402, a fluid via 1404, a fluid via 1406, and a fluid via 1408, and the ejection chip 1500 includes redundant zigzag fluid vias, such as a fluid via 1502, a fluid via 1504, a fluid via 1506, and a fluid via 1508. Each fluid via of the fluid vias 1402, 1404, 1406 and 1408 may be employed for supplying fluid of a particular color, such as cyan, magenta, yellow and black, to one or more ejecting elements (not shown) of the ejection chip 1400. Similarly, each fluid via of the fluid vias 1502, 1504, 1506 and 1508 may be employed for supplying fluid of a particular color, such as cyan, magenta, yellow and black, to one or more ejecting elements (not shown) of the ejection chip 1500. Further, the fluid vias 1402, 1404, 1406 and 1408 are aligned along a horizontal line CC' at one or more edges (not numbered) of the ejection chip 1400, in order to provide narrow printing zone in comparison to the ejection chips 1200 and 1300, without any nozzle redundancy at either end portions (not shown) of a printhead employing the ejection chip 1400. Similarly, the fluid vias 1502, 1504, 1506 and 1508 are aligned along a horizontal line DD' at one or more edges (not numbered) of the ejection chip 1500, in order to provide narrow printing zone in comparison to the ejection chips 1200 and 1300, without any nozzle redundancy at either end portions (not shown) of a printhead employing the ejection chip 1500.

Figure 16:
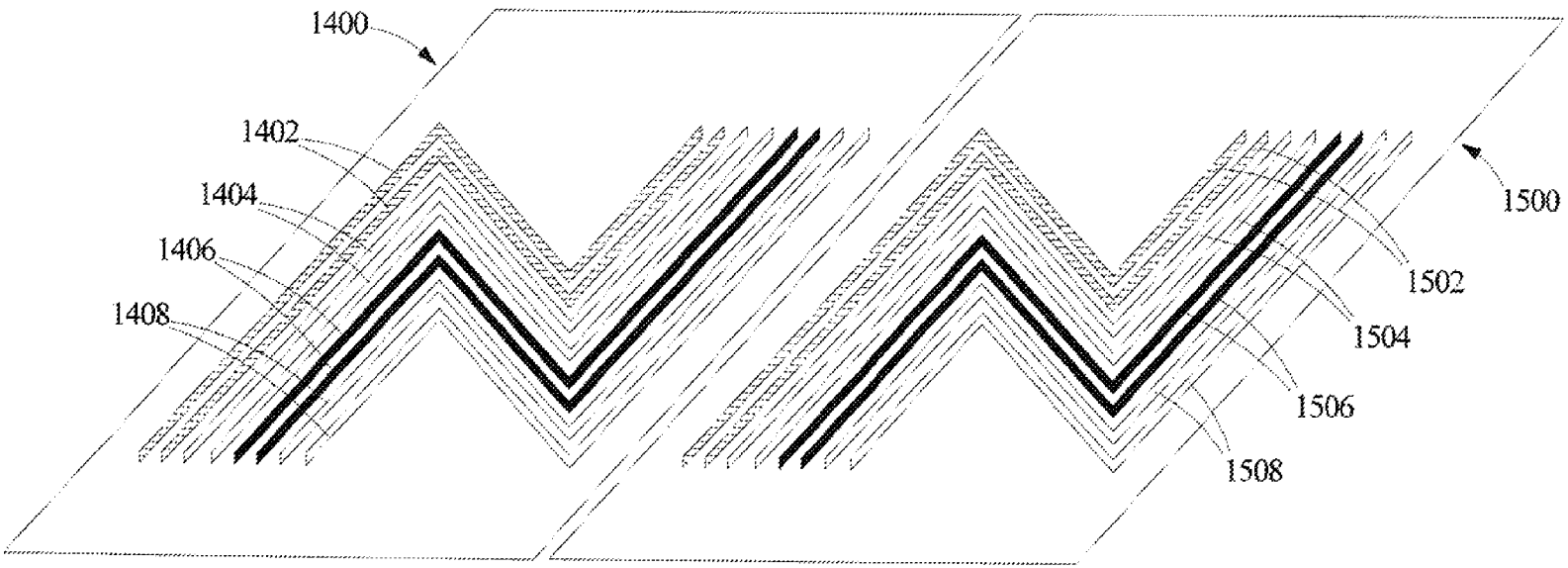
FIG. 16 illustrates a layout of NN type of in-line stitching pattern of the ejection chips of FIG. 15 depicting another arrangement of the redundant fluid vias, in accordance with an embodiment of the present disclosure.

FIG. 16 illustrates a layout of NN type of in-line stitching pattern of the ejection chips 1400 and 1500 depicting another arrangement of the redundant fluid vias, in accordance with an embodiment of the present disclosure. Specifically, the redundant fluid vias, such as the fluid vias 1402, which correspond to the same fluid color may be arranged together as depicted in FIG. 16.

Figure 17:
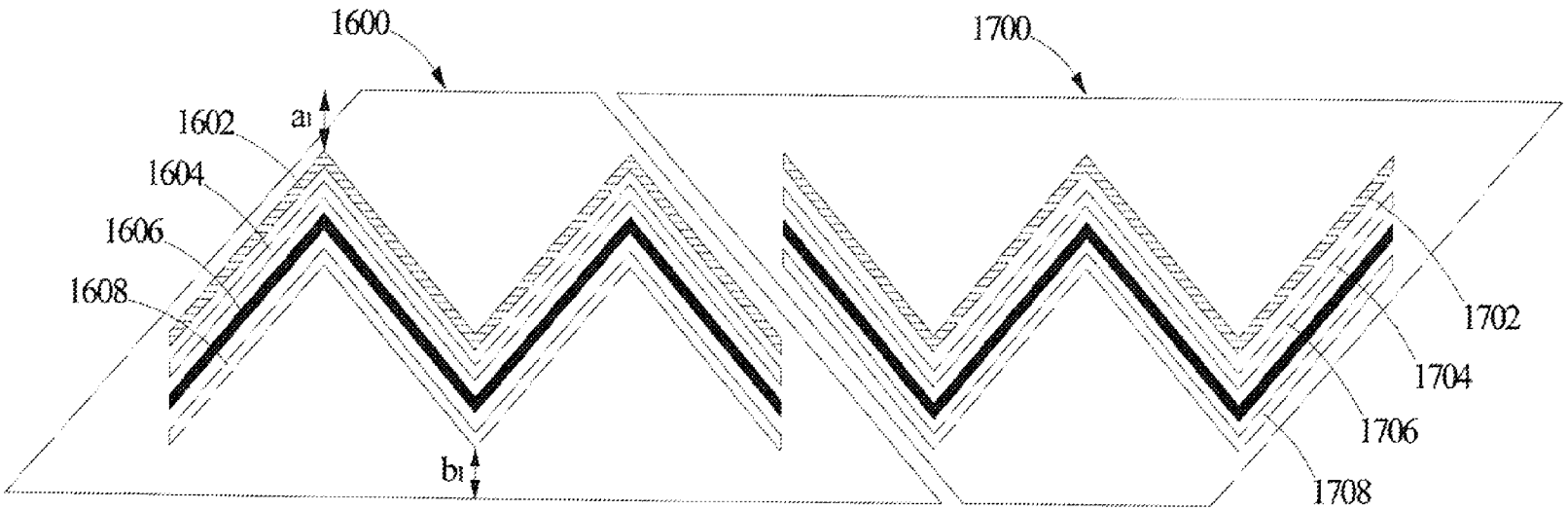
FIG. 17 illustrates a layout of MW type of in-line stitching pattern of ejection chips depicting an arrangement of non-redundant fluid vias, in accordance with an embodiment of the present disclosure.

FIG. 17 illustrates a layout of MW type of in-line stitching pattern of ejection chips 1600 and 1700 depicting an arrangement of non-redundant fluid vias, in accordance with an embodiment of the present disclosure. Specifically, the ejection chip 1600 includes non-redundant zigzag fluid vias, such as a fluid via 1602, a fluid via 1604, a fluid via 1606, and a fluid via 1608, and the ejection chip 1700 includes non-redundant zigzag fluid vias, such as a fluid via 1702, a fluid via 1704, a fluid via 1706, and a fluid via 1708. Each fluid via of the fluid vias 1602, 1604, 1606 and 1608 may be employed for supplying fluid of a particular color, such as cyan, magenta, yellow and black, to one or more ejecting elements (not shown) of the ejection chip 1600. Similarly, each fluid via of the fluid vias 1702, 1704, 1706 and 1708 may be employed for supplying fluid of a particular color, such as cyan, magenta, yellow and black, to one or more ejecting elements (not shown) of the ejection chip 1700. Further, each ejection chip of the ejection chips 1600 and 1700 is characterized by a small fluid via seal distance (i.e., a distance between two adjacent fluid vias of the each ejection chip) and a small chip edge seal distance (such as a distance between a respective horizontal edge (not numbered) of the ejection chip 1600 and a respective closest fluid via, as depicted by '$a_1$' and '$b_1$').

Figure 18:
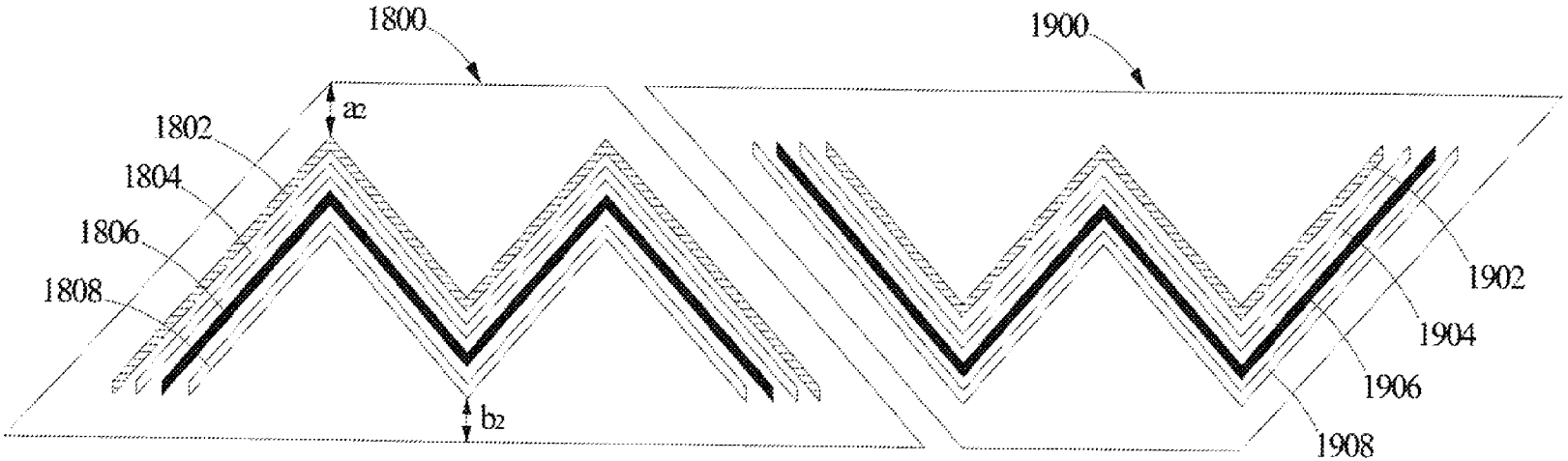
FIG. 18 illustrates a layout of MW type of in-line stitching pattern of ejection chips depicting an arrangement of non-redundant fluid vias, in accordance with another embodiment of the present disclosure.

FIG. 18 illustrates a layout of MW type of in-line stitching pattern of ejection chips 1800 and 1900 depicting an arrangement of non-redundant fluid vias, in accordance with another embodiment of the present disclosure. Specifically, the ejection chip 1800 includes non-redundant zigzag fluid vias, such as a fluid via 1802, a fluid via 1804, a fluid via 1806, and a fluid via 1808, and the ejection chip 1900 includes non-redundant zigzag fluid vias, such as a fluid via 1902, a fluid via 1904, a fluid via 1906, and a fluid via 1908. Each fluid via of the fluid vias 1802, 1804, 1806 and 1808 may be employed for supplying fluid of a particular color, such as cyan, magenta, yellow and black, to one or more ejecting elements (not shown) of the ejection chip 1800. Similarly, each fluid via of the fluid vias 1902, 1904, 1906 and 1908 may be employed for supplying fluid of a particular color, such as cyan, magenta, yellow and black, to one or more ejecting elements (not shown) of the ejection chip 1900. Further, each ejection chip of the ejection chips 1800 and 1900 is characterized by a small fluid via seal distance and a large chip edge seal distance (such as a distance between a respective horizontal edge (not numbered) of the ejection chip 1800 and a respective closest fluid via, as depicted by '$a_2$' and '$b_2$').

Figure 19:
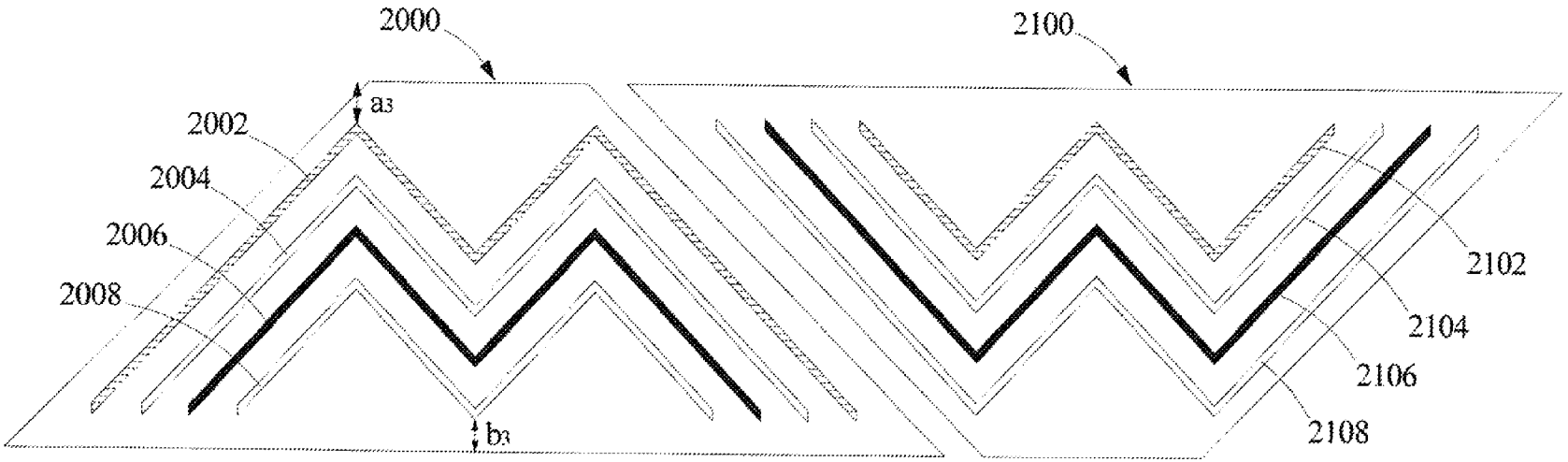
FIG. 19 illustrates a layout of MW type of in-line stitching pattern of ejection chips depicting an arrangement of non-redundant fluid vias, in accordance with yet another embodiment of the present disclosure.

FIG. 19 illustrates a layout of MW type of in-line stitching pattern of ejection chips 2000 and 2100 depicting an arrangement of non-redundant fluid vias, in accordance with yet another embodiment of the present disclosure. Specifically, the ejection chip 2000 includes non-redundant zigzag fluid vias, such as a fluid via 2002, a fluid via 2004, a fluid via 2006, and a fluid via 2008, and the ejection chip 2100 includes non-redundant zigzag fluid vias, such as a fluid via 2102, a fluid via 2104, a fluid via 2106, and a fluid via 2108. Each fluid via of the fluid vias 2002, 2004, 2006 and 2008 may be employed for supplying fluid of a particular color, such as cyan, magenta, yellow and black, to one or more ejecting elements (not shown) of the ejection chip 2000. Similarly, each fluid via of the fluid vias 2102, 2104, 2106 and 2108 may be employed for supplying fluid of a particular color, such as cyan, magenta, yellow and black, to one or more ejecting elements (not shown) of the ejection chip 2100. Further, each ejection chip of the ejection chips 2000 and 2100 is characterized by a large fluid via seal distance and a large chip edge seal distance (such as a distance between a respective horizontal edge (not numbered) of the ejection chip 2000 and a respective closest fluid via, as depicted by '$a_3$' and '$b_3$').

Figure 20:
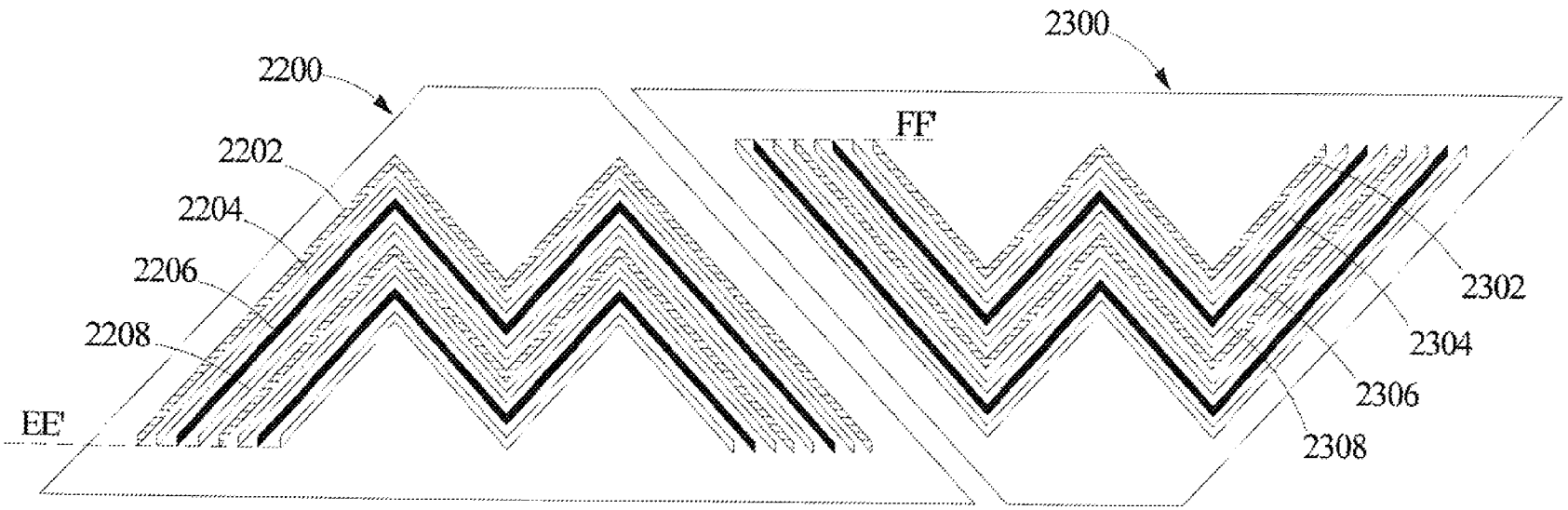
FIG. 20 illustrates a layout of MW type of in-line stitching pattern of ejection chips depicting an arrangement of redundant fluid vias, in accordance with an embodiment of the present disclosure.

FIG. 20 illustrates a layout of MW type of in-line stitching pattern of ejection chips 2200 and 2300 depicting an arrangement of redundant fluid vias, in accordance with yet another embodiment of the present disclosure. Specifically, the ejection chip 2200 includes redundant zigzag fluid vias, such as a fluid via 2202, a fluid via 2204, a fluid via 2206, and a fluid via 2208, and the ejection chip 2300 includes redundant zigzag fluid vias, such as a fluid via 2302, a fluid via 2304, a fluid via 2306, and a fluid via 2308. Each fluid via of the fluid vias

2202, 2204, 2206 and 2208 may be employed for supplying fluid of a particular color, such as cyan, magenta, yellow and black, to one or more ejecting elements (not shown) of the ejection chip 2200. Similarly, each fluid via of the fluid vias 2302, 2304, 2306 and 2308 may be employed for supplying fluid of a particular color, such as cyan, magenta, yellow and black, to one or more ejecting elements (not shown) of the ejection chip 2300. Further, the fluid vias 2202, 2204, 2206 and 2208 are aligned along a horizontal line EE' at one or more edges (not numbered) of the ejection chip 2200. Similarly, the fluid vias 2302, 2304, 2306 and 2308 are aligned along a horizontal line FF' at one or more edges (not numbered) of the ejection chip 2300.

Figure 21:
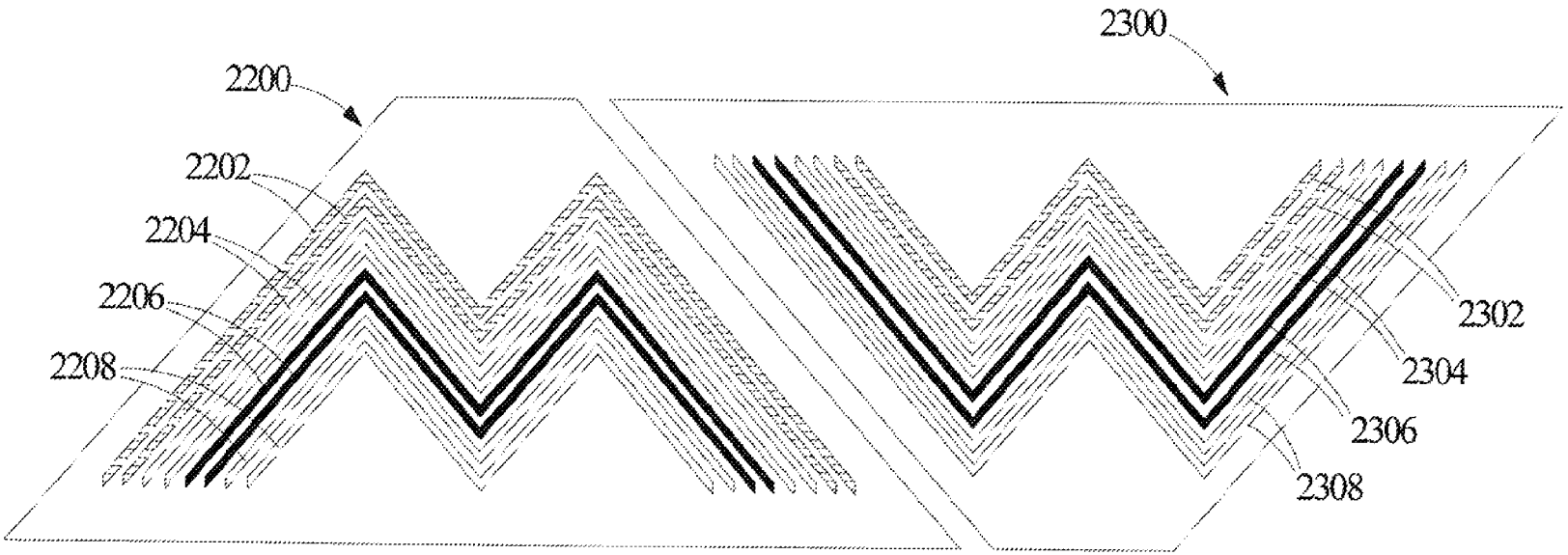
FIG. 21 illustrates a layout of MW type of in-line stitching pattern of the ejection chips of FIG. 20 depicting another arrangement of the non-redundant fluid vias, in accordance with an embodiment of the present disclosure.

FIG. 21 illustrates a layout of MW type of in-line stitching pattern of the ejection chips 2200 and 2300 depicting another arrangement of the redundant fluid vias, in accordance with an embodiment of the present disclosure. Specifically, the redundant fluid vias, such as the fluid vias 2202, which correspond to the same fluid color may be arranged together as depicted in FIG. 21.

The ejection chips 600-2300 of FIGS. 10-21 are shown to include zigzag fluid vias at respective edges of the ejection chips 600-2300 only for proof-of-concept of stitching and simplicity. Accordingly, it may be evident that respective central portions of the ejection chips 600-2300 may have multiple end-to-end coupled segments of the zigzag fluid vias.

The present disclosure provides an ejection chip, such as the ejection chips 200-2300, for an inkjet printhead. The ejection chip includes at least one fluid via and a plurality of nozzles configured along the fluid via with a first nozzle spatial density, which is less than a second nozzle spatial density that is required by the prior art for achieving a predetermined print resolution. Accordingly, such a configuration facilitates the inkjet printhead to achieve a photo print quality with reduced first nozzle spatial density for improved reliability of PINP forming processes while favoring wider flow feature separation between neighboring nozzles of the plurality of nozzles for better adhesion between a flow feature layer and ejection chip/nozzle plate of the inkjet printhead.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. An ejection chip for an inkjet printhead, the ejection chip comprising:

at least one fluid via configured on the ejection chip for supplying fluid to one or more ejecting elements of the ejection chip, each fluid via of the at least one fluid via comprising, a continuous channel through the ejection chip defined by a plurality of end-to-end coupled segments, each segment of the plurality of end-to-end coupled segments being aligned at a skew angle with a consecutive segment; and a plurality of nozzles configured along a length of the each segment of the plurality of end-to-end coupled segments with a first nozzle spatial density, the configuration of the plurality of nozzles facilitating in achieving a predetermined print resolution with the first nozzle spatial density.

2. The ejection chip of claim 1, wherein the predetermined print resolution is about 1800 Dots per Inch (dpi), and the first nozzle spatial density is about 1273 dpi.

3. The ejection chip of claim 1, wherein a nozzle of the plurality of nozzles is located at a respective concave corner point between two consecutive segments of the end-to-end coupled segments.

4. The ejection chip of claim 1, wherein a nozzle of the plurality of nozzles is located at a respective convex corner point between two consecutive segments of the end-to-end coupled segments.

5. The ejection chip of claim 1, wherein the each segment of the plurality of end-to-end coupled segments has linear end portions.

6. The ejection chip of claim 1, wherein the each segment of the plurality of end-to-end coupled segments has curved end portions.

7. The ejection chip of claim 1, further comprising a plurality of manifolds configured within a base of the ejection chip and adjacent to the at least one fluid via for fluid distribution.

8. The ejection chip of claim 1, wherein the first nozzle spatial density is less than a second nozzle spatial density required for achieving the predetermined print resolution.

9. The ejection chip of claim 8, wherein the second nozzle spatial density is about 1800 dpi.

10. The ejection chip of claim 1, wherein the skew angle is one of an acute angle, an obtuse angle, and a right angle.

11. An ejection chip for an inkjet printhead, the ejection chip comprising:

at least one fluid via configured on the ejection chip for supplying fluid to one or more ejecting elements of the ejection chip, each fluid via of the at least one fluid via comprising, a continuous channel through the ejection chip defined by a plurality of end-to-end coupled segments, each segment of the plurality of end-to-end coupled segments being aligned at a skew angle with a consecutive segment; and a plurality of nozzles configured along a length of the each segment of the plurality of end-to-end coupled segments with a first nozzle spatial density, the configuration of the plurality of nozzles facilitating in achieving a predetermined print resolution with the first nozzle spatial density, wherein the first nozzle spatial density is less than a second nozzle spatial density required for achieving the predetermined print resolution.

12. The ejection chip of claim 11, wherein the predetermined print resolution is about 1800 Dots per Inch (dpi), the first nozzle spatial density is about 1273 dpi, and the second nozzle spatial density is about 1800 dpi.

13. The ejection chip of claim 11, wherein the skew angle is one of an acute angle, an obtuse angle, and a right angle.

* * * * *